US006127046A

United States Patent [19]

Worden et al.

[11] Patent Number: 6,127,046

[45] Date of Patent: Oct. 3, 2000

[54] FORMATION OF A GRAPHITE-FREE SURFACE IN A FERROUS MATERIAL TO PRODUCE AN IMPROVED INTERMETALLIC BOND

[75] Inventors: John A. Worden, Hope; Gordon L. Starr; Yong-Ching Chen, both of Columbus, all of Ind.

[73] Assignee: Cummins Engine Company, Inc., Columbus, Ind.

[21] Appl. No.: 08/984,865

[22] Filed: Dec. 4, 1997

[51] Int. Cl.[7] ..... B32B 15/18; B05D 3/14

[52] U.S. Cl. ..... 428/612; 428/651; 428/652; 428/653; 428/661; 428/667; 428/682; 427/309; 228/206; 228/208; 148/531; 148/537

[58] Field of Search ..... 428/653, 652, 428/651, 661, 667, 612, 682; 148/537, 530, 532, 533, 531; 427/431, 329, 376.8, 309; 219/121.6; 228/206, 208, 209, 262.4

[56] References Cited

U.S. PATENT DOCUMENTS

| | | | |
|---|---|---|---|
| 2,544,671 | 3/1951 | Grange et al. | 22/204 |
| 3,183,796 | 5/1965 | Christen et al. | 92/229 |
| 4,008,051 | 2/1977 | Cadle | 29/182.3 |
| 4,014,417 | 3/1977 | Kugler et al. | 191/29 DM |
| 4,899,702 | 2/1990 | Sasaki et al. | 123/193 P |
| 4,987,867 | 1/1991 | Suzuki et al. | 123/193 P |
| 4,997,024 | 3/1991 | Cole et al. | 164/75 |
| 5,119,777 | 6/1992 | Mielke et al. | 123/193.6 |
| 5,146,883 | 9/1992 | Reipert et al. | 123/193.6 |
| 5,249,554 | 10/1993 | Tamor et al. | 123/90.51 |
| 5,333,668 | 8/1994 | Jorstad et al. | 164/100 |

*Primary Examiner*—John J. Zimmerman
*Attorney, Agent, or Firm*—Woodard, Emhardt, Naughton, Moriarty & McNett

[57] ABSTRACT

An intermetallic bond between a ferrous metal and a non-ferrous metal wherein an intermetallic bond layer that is substantially free of graphic inclusions joins the two. The graphite is effectively eliminated from the bond layer by either removing it from the ferrous metal or by sealing it off from the bond layer. Graphite removal may be accomplished in a variety of ways, including electrochemical cleaning and laser surface treatment. Alternatively, the graphite may be prevented from incursing into the bond region by sealing it off with a layer of metal, such as a chromium plating, that prevents it from penetrating through the bond layer and into the non-ferrous metal.

17 Claims, 6 Drawing Sheets

FORMATION OF A GRAPHITE-FREE SURFACE IN A FERROUS MATERIAL TO PRODUCE AN IMPROVED INTERMETALLIC BOND

TECHNICAL FIELD OF THE INVENTION

The present invention relates generally to a method for removing impurities from metallic surfaces, and more particularly, to a method for preparing a ferrous surface for intermetallic bonding.

BACKGROUND OF THE INVENTION

It is well known among metallurgists that cast iron and other ferrous materials (i.e. iron and iron containing alloys) contain carbon as a result of the casting process. Upon cooling, the carbon precipitates out of solution and is present in the piece as graphite flakes. The size and distribution of the graphite flakes can vary as a function of the alloy, as well as of the parameters of the casting and cooling processes.

One process for bonding iron or ferrous pieces with principally aluminum pieces is the AlFin process. In the AlFin process, the bonding surface of the ferrous piece is immersed in molten aluminum in order to form an intermetallic Al—Fe bonding surface layer. The aluminum piece is then bonded to the ferrous piece at the Al—Fe intermetallic layer.

The AlFin process is commonly used, for example, to bond ferrous alloy piston ring carriers to aluminum pistons, such as those used in diesel engines. The bonds must be strong enough to withstand the stresses generated by the elevated temperatures and pressures produced during the operation of a diesel engine. If the cohesion is weak, debonding may occur. The problem of debonding is especially troublesome if the debonding should happen while the engine is in service. Therefore, one limitation generally associated with the prior AlFin process is debonding under prolonged exposure to high pressure/temperature environments and debonding under acute exposure to extreme pressure/temperature environments.

Hence, there is a need for an improved ferrous-to-nonferrous metal bonding process (and in particular an improved iron-to-aluminum bonding process) capable of producing intermetallic bonds that are stronger and more resistant to harsh environments. In the case of aluminum pistons used in diesel engines, the intermetallic bond between the piston and piston ring carrier must be able to withstand prolonged exposure to the high pressure/temperature environment of the engine as well as acute exposures to pressure and temperature extremes without debonding. A means for satisfying this need has so far eluded those skilled in the art.

SUMMARY OF THE INVENTION

One form of the present invention contemplates the strengthening of the intermetallic bond formed between a ferrous and non-ferrous metal through the elimination of graphite as a phase present in the intermetallic bond region.

Another form of the present invention contemplates a method of removing graphite from the intermetallic bond region by either removing the graphitic contaminants from the surface region of the ferrous metal or by sealing the graphite into the surface of the ferrous metal.

One object of the present invention is to provide a means for preventing graphite incursion into the intermetallic bond layer formed between the ferrous and nonferrous metals.

Another object of the present invention is to provide a means for increasing the strength of the intermetallic bond formed between a ferrous and a nonferrous metal.

Yet another object of the present invention is to increase the strength between the bond formed between a ferrous metal piece, such as an iron piston ring carrier, and a substantially aluminum piece, such as a piston.

Related objects and advantages of the present invention will be apparent from the following description.

DETAILED DESCRIPTION OF THE PREFERRED EMBODIMENT

Figure 1:
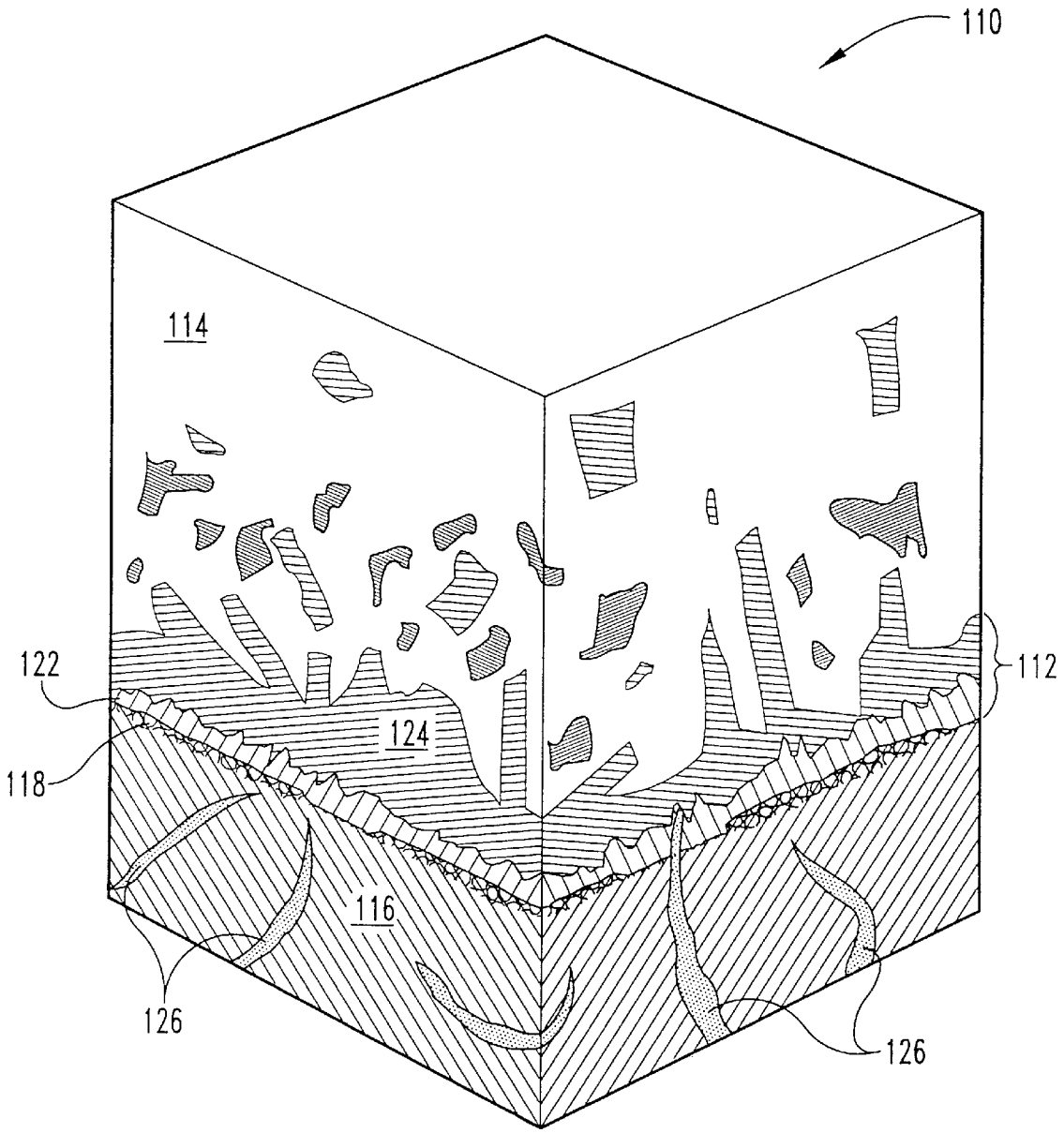
Fig. 1 (Prior Art)
FIG. 1 is a schematic view of a prior art AlFin bond.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention relates generally to an improved process for ferrous/non-ferrous intermetallic bonding, such as bonding between iron and aluminum. More particularly, the present invention has one form wherein a nickel-iron alloy surface is prepared for bonding with an aluminum alloy surface through the removal of residual graphite flakes from the bonding surface. The absence of graphite as a participant in the bond results in increased bond strength.

Current bonds between ferrous (iron or iron alloy) metals and non-ferrous metals (such as aluminum or aluminum alloys) are weakened by the presence of graphite flakes in the intermetallic bond layer. Many non-ferrous metals, such as aluminum, wet graphite slightly or not at all. As a result, graphite incursive through the intermetallic bond layer into the non-ferrous metal layer does not bond to the non-ferrous metal, but merely rests in situ. Graphite flakes so situated do not enhance bond strength, but instead weaken the bond by providing effective voids that act as stress concentrators and facilitate crack propagation.

An example of a bond between a ferrous and nonferrous metal is that formed between cast iron and aluminum. This bond is currently accomplished by first treating the iron piece using the AlFin process. The AlFin bonding process is used to metallurgically bond aluminum alloy and ferrous alloy pieces, such as aluminum diesel engine pistons and iron-nickel alloy piston ring carriers, directly together. The AlFin bonding process begins with the growth of an Al intermetallic surface layer on the ferrous piece by immersion of the ferrous piece in a molten Al bath. The molten Al bath is typically composed of an Al-6% Si alloy but may vary in composition. The Al intermetallic layer is typically grown to about 50 microns in thickness. Bath temperatures typically range from 1320 F to 1380 F. The thickness of the Al intermetallic layer increases with bath temperature and immersion time. Immersion time typically ranges from 3 to 18 minutes. The ferrous piece is then bonded directly to the aluminum piece through the formation of a metallurgical bond between the Al intermetallic layer on the ferrous piece and the aluminum piece.

One problem with the AlFin process is that the bond may sometimes fail under elevated temperature and/or pressure applications. For example, this type of failure is observed in the AlFin bond between Al diesel engine pistons and Fe—Ni (Ni-resist) alloy piston ring carriers when the pistons are in service. Under prolonged exposure to the elevated temperature and pressure conditions present in the diesel engine operating environment, the AlFin bond between the aluminum piston and the Ni-resist piston ring carrier can fail catastrophically.

The AlFin bond schematic 110 illustrated in FIG. 1 shows a typical prior art AlFin bond 112 between an aluminum alloy piece 114, such as a diesel engine piston, and an iron alloy piece 116, such as a Ni-resist piston ring carrier. Several distinct phases are observed in addition to the iron alloy 116 and aluminum alloy 114 pieces. Thin deposits of $Fe_3(Si_{0.9}Al_{0.1})$ 118 and (Al,Fe,Si) 120 phases appear adjacent to the surface of the iron alloy 116. A relatively thick layer of beta-$Al_5FeSi$ 124 extends into the Al alloy matrix 114. Graphite flakes 126, inherent in cast ferrous pieces extend through the boundary of the iron alloy 116 piece and penetrate the bond region 112.

Figure 2:
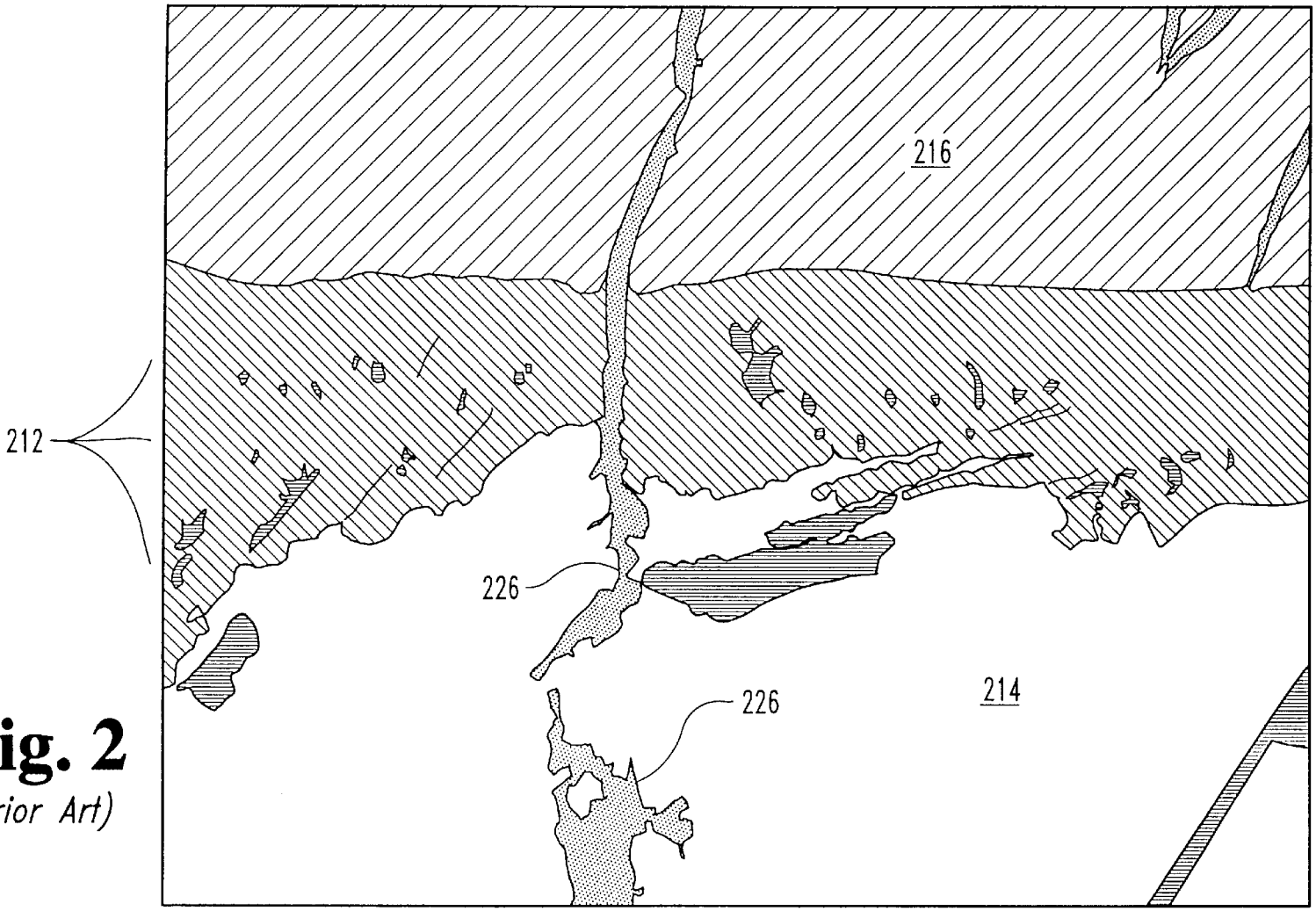
Fig. 2 (Prior Art)
FIG. 2 is a cross-sectional illustration of a prior art AlFin bond.

Graphite is a common phase in cast iron pieces. Carbon is introduced to the ferrous system as a reducing agent and remains in significant quantities. Upon cooling of the ferrous piece, graphite crystals precipitate out and grow as a distinct phase. FIG. 2 is an illustration of graphite penetration through a typical AlFin bond illustrated schematically at 210. During the AlFin aluminum coating process, there is a dissolution of Fe from the surface of the iron alloy 214 piece immersed in the molten Al bath. The dissolution of the Fe occurs as a continuous process simultaneous with the formation of the intermetallic bond layer 212. At the resulting dynamic interface, graphite flakes 226 become exposed as the ferrous surface dissolves into the molten Al bath. The intermetallic bond layer 212 forms around the graphite flakes 226, but does not bond to them since aluminum does not wet graphite. The result is the presence of relatively weak graphite flakes 226 extending through, but not bonded to, the intermetallic bond layer 212. The graphite flakes 226 are not bonded to the aluminum matrix 216 or bond layer 212 holding them in situ, and act as effective voids in the bond structure, thereby providing propagation points for cracks.

In order to test the bond strength resulting from the prior art process, the tensile strengths of typical AlFin bonds were measured in samples sectioned from AlFin bond regions by electron discharge machining (EDM). The test bars were sectioned normal to the bond layer and were prepared with the AlFin bond layer located in the gage region of the specimen. The tensile strength of 10 randomly selected production lot specimens was measured. A mean tensile strength of 12,350 psi was obtained.

Photomicrographs of the AlFin bond region revealed the presence of graphite flakes extending from the ferrous piece through the bond and into the aluminum piece. It was theorized that the removal of graphite from the bond region would strengthen the bond by eliminating a non-bonding phase from the bond region and aluminum matrix of the aluminum piece. Partial removal of graphite from the surface of the ferrous piece was accomplished by cleaning the surface using the KOLENE process. The partial removal of graphite from the bond layer in accordance with the present invention has resulted in an increase of the bond strength. It was observed that the bond strength increased with the degree (both as frequency and depth of graphitic inclusions) of graphite removal achieved. Complete removal of graphite from the surface of the ferrous piece resulted in an even greater increase in the ferrous/non-ferrous bond strength. A minimum removal depth of about 200 microns was found to be preferred in order to substantially or completely remove graphite from the AlFin bond area. Several different methods were used to remove graphite from the surface of the ferrous piece. Graphite was chemically removed from the surface of the ferrous piece by means of the KOLENE process of chemical cleaning. The KOLENE process was found to remove graphite to a depth of about 60 microns. Graphite was also removed from the ferrous surface through laser treatment to a surface depth of about 400 microns. Preliminary load tests, wherein the entire body was loaded in tension through the bond until failure, indicate that laser treatment of the surface increases the bond strength by at least about 60%. A third method of effective graphite removal from the surface of the ferrous piece was through the plating of a chromium layer onto the ferrous piece prior to the molten aluminum bath step of the AlFin process. The Cr layer seals the surface of the ferrous piece with respect to dissolution of iron in the molten Al bath. This seal prevents the erosion of the surface iron and the resulting exposure of graphite flakes to the intermetallic bond layer. Preliminary loading strength tests of the bonds of the Cr plated pieces indicate a strength increase well in excess of 60% over the nontreated, as-produced bond strengths.

One embodiment of the present invention is the preparation of the surface of the ferrous piece for AlFin bonding through the use of a modification of the commercial KOLENE process to remove surface graphite. The KOLENE process involves the use of an alkaline based molten salt bath, such as NaCl, maintained in the temperature range from 750 F to 900 F to oxidize graphitic carbon from the surface of the ferrous piece. The ferrous piece is alternately charged positively and negatively with respect to the molten salt bath to alternately facilitate oxidation and reduction reactions. Graphite is removed during the oxidation reaction. When the ferrous workpiece is charged positively with respect to the molten salt bath, the graphite oxidizes and is removed as $CO_2$. The ferrous piece also oxidizes during this phase of the process, however, and $Fe_2O_3$ is accumulated at the surface. In the present embodiment of the invention, the $Fe_2O_3$ is removed by reversing the polarity of the workpiece and reducing the $Fe_2O_3$ in the presence of Na ions to $Na_2Fe_2O_4$, which is removed as a sludge. The timing at which the polarity of the workpiece is periodically reversed was modified in order to achieve a graphite removal depth greater than with the standard KOLENE process.

Figure 3:
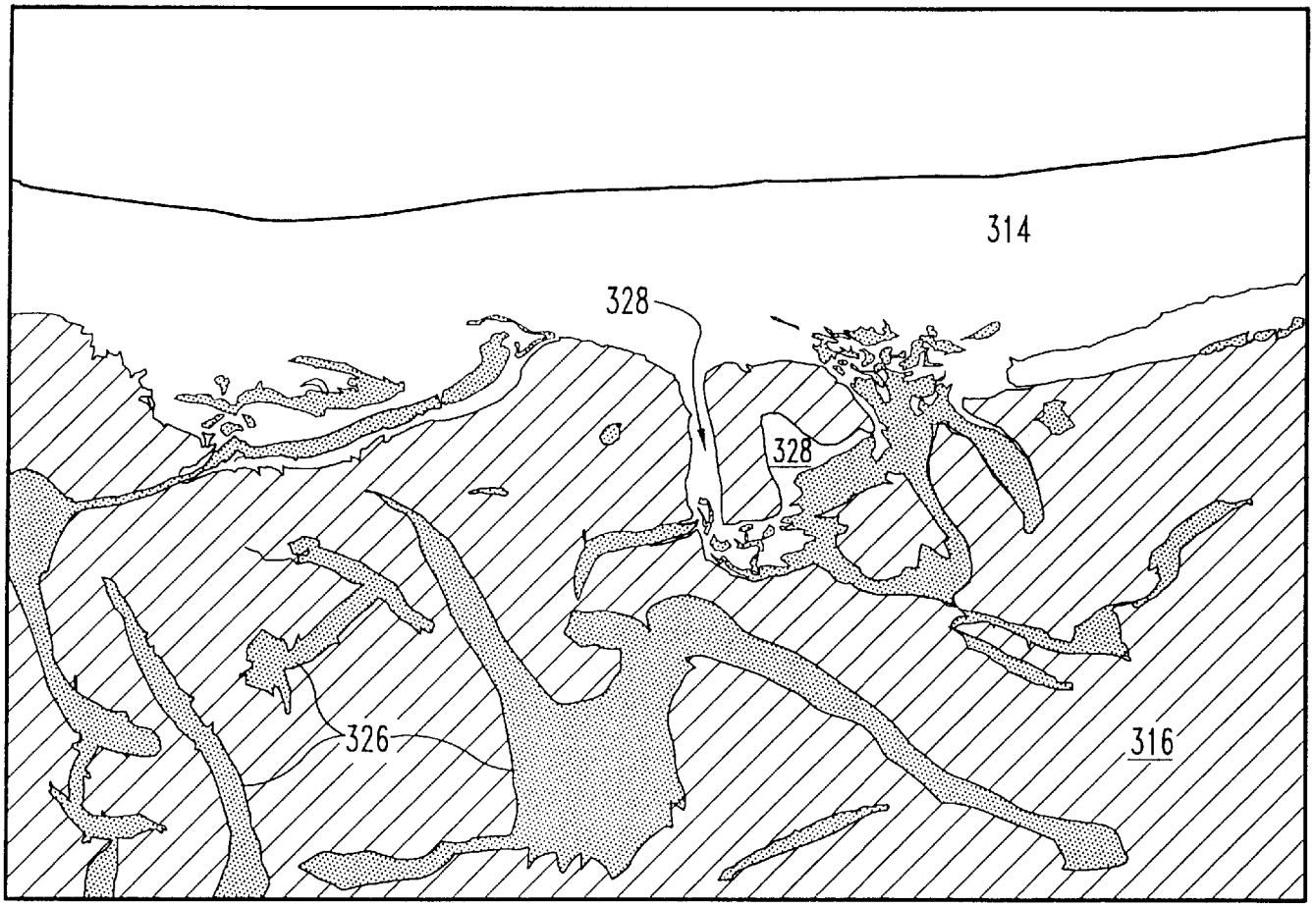
FIG. 3 is a cross-sectional illustration of an AlFin bond between an aluminum surface and a ferrous surface which has been cleaned with the KOLENE process.
Figure 4:
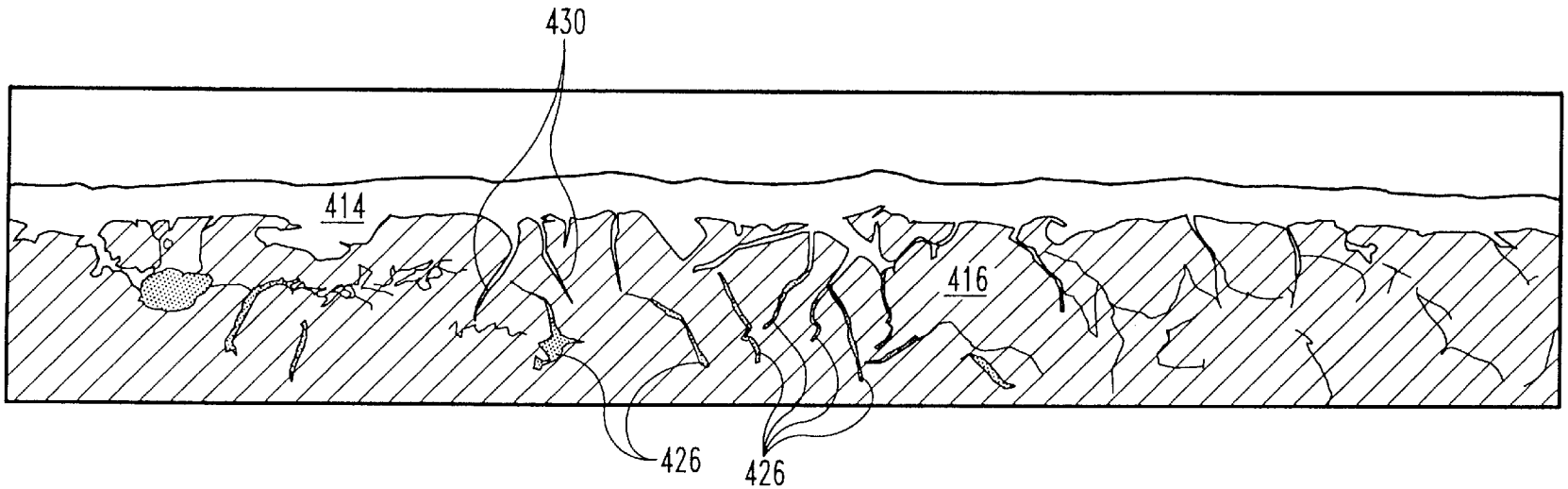
FIG. 4 is a cross-sectional illustration of an AlFin bond between an aluminum surface and a ferrous surface which has been cleaned with the KOLENE process.
Figure 5:
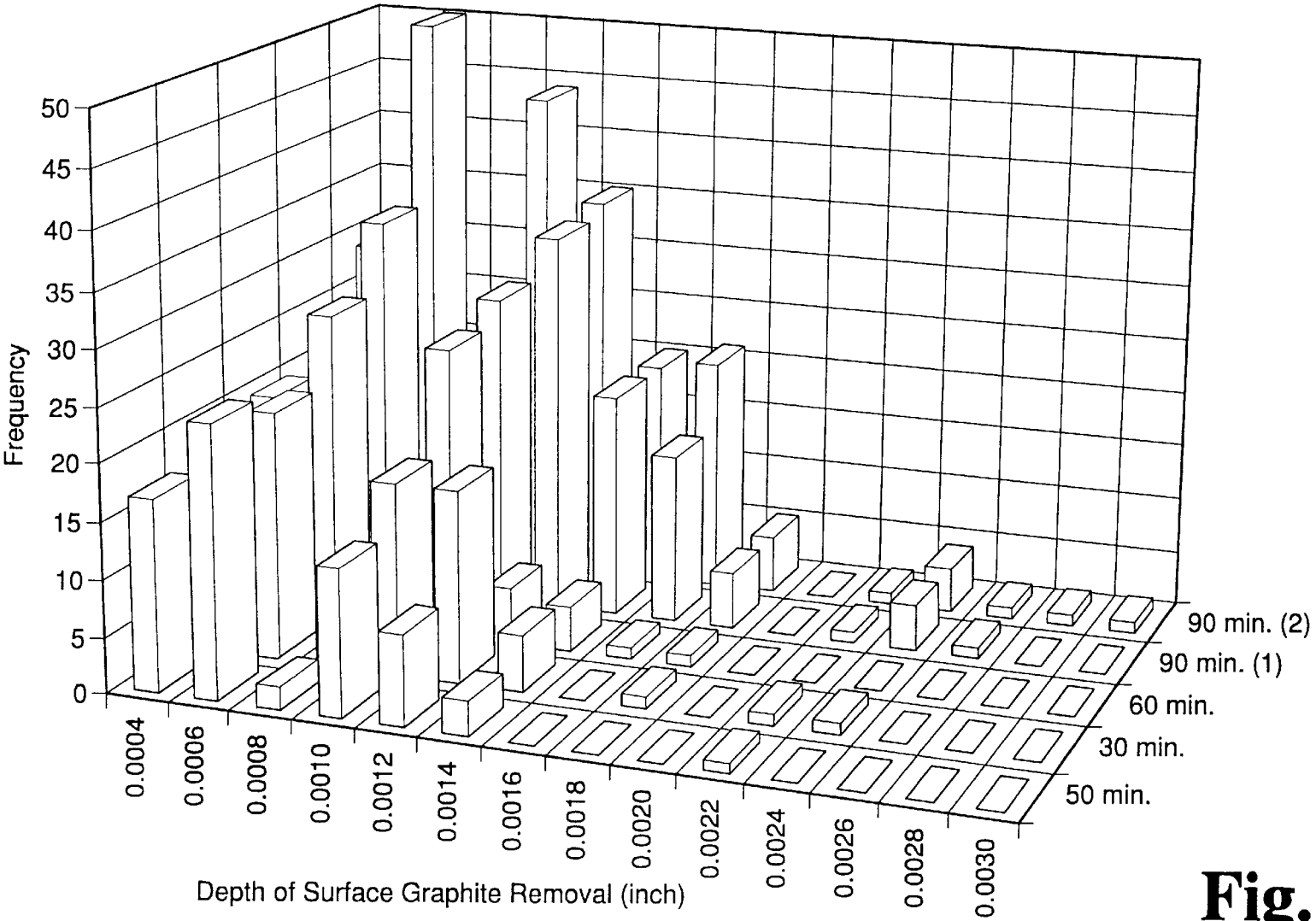
FIG. 5 is a graphical representation of the relationship between length of cleaning with the KOLENE process and removal depth of graphite from a ferrous surface.

The metallurgical interface obtained in this way displays excellent bonding behavior, and is illustrated as FIGS. 3 and 4. In FIG. 3, the surface of the iron alloy material 316 has been treated with the KOLENE process. Surface graphite has been removed, while deeper graphitic inclusions 326 remain. The surface topography includes irregularly shaped voids 328 left by the oxidized graphite and reduced $Fe_2O_3$. This irregular surface topography is ideal for bonding, as a second metallic phase 314, such as the molten Al, can readily flow into and occupy the irregularly shaped voids 328, in effect mechanically interlocking as well as metallurgically bonding with the surface of the ferrous piece. This interlocking is illustrated in FIG. 4. The iron alloy piece 416 is mechanically interlocked with the metallic second phase 414 by the action of the metallic second phase 414, while molten, flowing into the voids left in the iron alloy piece 416 by the oxidation of graphitic inclusions and the reduction of oxide inclusions. Interlocking tendrils 430 of the metallic second phase material penetrate the iron alloy piece 416 to enhance bonding. Graphitic inclusions 426 still exist below the effective removal depth of the KOLENE process. The depth of graphite removal typical of treatment with the KOLENE process is only about 60 microns. This is displayed graphically as FIG. 5. It has been found that graphite is preferably removed to a depth of approximately 200 microns or more to optimally prepare a surface for the AlFin process, or there will be some residual graphite present to weaken the resulting intermetallic bond layer after surface dissolution. While this approach demonstrates that an electrochemical or chemical reaction process can be used to remove graphite from the bonding surface, the present KOLENE process does not remove graphite to a depth sufficient to substantially strengthen the bond.

Figure 6:
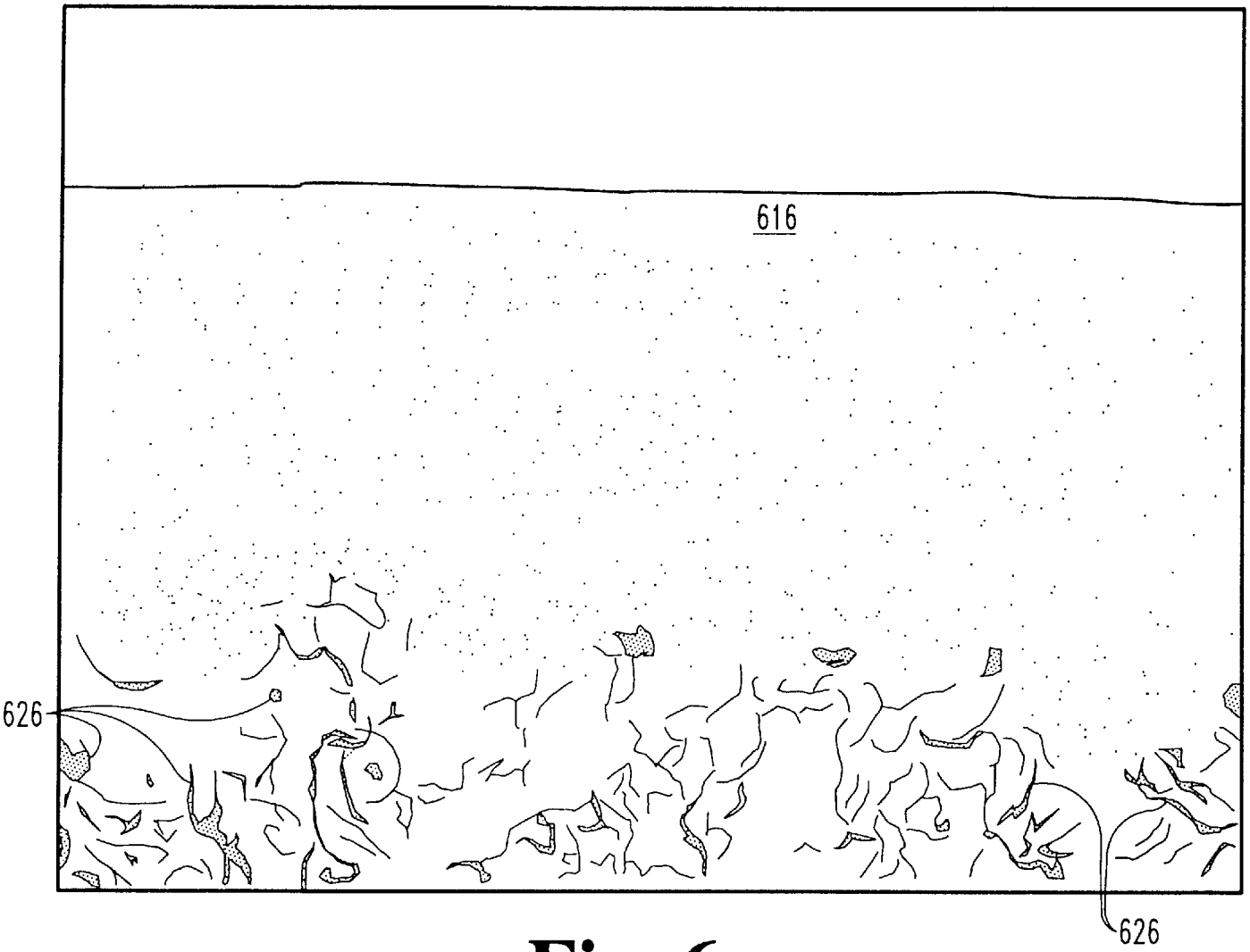
FIG. 6 is a cross-sectional illustration of a laser-cleaned ferrous surface.

A second embodiment of the present invention is illustrated as FIG. 6 and involves the treatment of the ferrous surface 616 with a laser beam, such as from a $CO_2$ laser capable of producing an ultraviolet beam, in order to remove graphitic impurities 626 to a depth in excess of 200 microns. The laser can be rastered over the ferrous surface 616 at a speed sufficient to vaporize the graphitic impurities 626 by local superheating. The resulting ferrous surface 616 is uniformly smooth and free of graphitic impurities 626 to a depth exceeding 200 microns. The raster speed necessary to achieve adequate surface graphite removal is a function of the power of the laser and the graphitic impurity level of the ferrous piece 616. The resulting surface 616 is relatively smooth and homogenous. The application of the AlFin process thereto results in a smooth and even coating of Al and the formation of a relatively uniform intermetallic layer, free of graphitic penetration or impurities.

A third embodiment of the present invention is achieved through the plating of the ferrous piece with a transition metal of relatively low carbon solubility, such as chromium, in order to physically seal off the graphite during the AlFin process. Such transition metals include, but are not limited to, titanium, vanadium, chromium, cobalt, nickel, copper, silver, gold, palladium, niobium, molybdenum, and platinum. The plating layer provides an effective barrier during the AlFin process by preventing surface dissolution of the Fe into the Al solution, thereby preventing exposure of the graphite flakes. The AlFin intermetallic bond forms on the exterior of the chromium plated surface of the ferrous piece. Thusly, the bond formed between the chromium treated ferrous piece and the aluminum piece is free of graphitic impurities.

Tensile strength testing was performed on samples taken from the bond regions of AlFin bonds between aluminum alloy pistons and unmodified Ni-resist piston ring carriers, as well as on samples taken from the bond region of AlFin bonds between aluminum alloy pistons and laser-treated Ni-resist piston ring carriers and between aluminum alloy pistons and chromium-coated Ni-resist piston ring carriers. The samples were sectioned normal to the plane of the bond by EDM. Ten specimens were prepared from the untreated, the laser-treated, and the chromium-coated bonds. The tensile strengths of the bonds were measured by a load strength test.

Load testing of AlFin bonds between aluminum pistons and both laser-treated and chrome-plated piston rings indicate that both processes for graphite removal from participation in the bond interface result in substantial increases in bond strength. Load testing of the bonded pistons made with the laser-treated piston rings indicates a 60% increase in bond strength. Load testing of the bonded pistons made with the chrome-plated piston rings indicates a bond strength in excess of 60% (the bond strengths exceeded the measuring range of the available measuring equipment.)

It is clear that any effective removal of graphite from the AlFin bond interface will result in an increase in bond strength. Bond strength is also enhanced by the increase in effect-ve bonding surface area produced by removing graphite flakes from the ferrous surface while leaving behind the voids to be filled in during bonding. Bond strength is therefore enhanced by both metallurgical and mechanical bonding.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of producing a substantially graphite-free intermetallic ferrous bond, comprising the steps of:

a) identifying a ferrous first surface and a metallic second surface to be bonded together;

b) treating said first surface by plating a bonding layer thereto to substantially eliminate graphite from a bond; and c) preparing said ferrous first surface for bonding by immersing said ferrous first surface in a molten substantially aluminum bath; and d) thermally joining said prepared ferrous first surface and said metallic second surface intermetallically in said bonding layer;

wherein the bonding layer is a metal selected from the group consisting of chromium, vanadium, titanium, cobalt, palladium, niobium, molybdenum, and platinum; and wherein the ferrous first surface is cast.

2. The method of claim 1 wherein step (b) further comprises substantially eliminating graphite from said bonding area by plating said second surface with a transition metal.

3. The method of claim 1 wherein graphite is substantially eliminated from said bond by plating said first surface with chromium.

4. An intermetallic bond between a ferrous metal and a non-ferrous metal, comprising:

a ferrous layer;

a non-ferrous metal layer; and an intermetallic bond layer about 200 microns thick and substantially free of graphite joining said non-ferrous and ferrous layers.

5. The bond of claim 4 wherein a region extending from the intersection of the non-ferrous metal layer and the intermetallic bond layer and through the intermetallic bond layer is substantially free of graphite to a depth of approximately 200 microns.

6. The bond of claim 4 wherein said ferrous layer is cast iron.

7. The bond of claim 4 wherein said non-ferrous layer is aluminum.

8. The bond of claim 4 wherein said intermetallic layer is an Fe—Al alloy.

9. The bond of claim 4 wherein said non-ferrous layer is an aluminum alloy.

10. The intermetallic bond of claim 4 wherein the ferrous layer is cast iron;

wherein the non-ferrous layer is substantially aluminum; and wherein the intermetallic layer is an iron-aluminum alloy.

11. A method for intermetallically bonding a ferrous body to a non-ferrous metallic body comprising the steps of:

a) providing a ferrous body having a ferrous bonding surface and a non-ferrous metal body having a non-ferrous metal bonding surface to be bonded together;

b) removing graphite from said ferrous bonding surface to a depth of at least 200 microns;

c) creating a substantially graphite-free intermetallic bond having a thickness of about 200 microns between said ferrous bonding surface and said non-ferrous metal bonding surface.

12. The method of claim 11 wherein graphite is removed from said ferrous surface by electrochemical washing.

13. The method of claim 11 wherein graphite is removed from said ferrous surface by laser treatment.

14. The method of claim 11 wherein graphite is removed said ferrous surface by rastering a laser over said ferrous surface.

15. The method of claim 11 further comprising the steps of:

d) immersing said ferrous body in a bath of molten substantially aluminum;

e) forming an intermetallic iron-aluminum surface layer on said ferrous body;

f) joining said ferrous body and said non-ferrous body through the said intermetallic bond.

16. The method of claim 11 wherein graphite is removed from said ferrous bonding surface through laser vaporization.

17. A method of intermetallically bonding a ferrous body having graphitic impurities to a non-ferrous metallic body comprising:

a) providing a non-ferrous body having a non-ferrous bonding surface;

b) providing a ferrous body having graphitic impurities and having a ferrous bonding surface;

c) treating at least one of the surfaces to substantially prevent graphite from interfering with the bonding process;

d) establishing a substantially graphite-free intermetallic bond having a thickness of about 200 microns and contiguous with and between the ferrous bonding surface and the non-ferrous bonding surface joining the ferrous body to the non-ferrous body.

* * * * *